US011000959B2

(12) United States Patent
Appiah

(10) Patent No.: US 11,000,959 B2
(45) Date of Patent: May 11, 2021

(54) SHAVING APPARATUS

(71) Applicant: Kwadwo Appiah, Bronx, NY (US)

(72) Inventor: Kwadwo Appiah, Bronx, NY (US)

( * ) Notice: Subject to any disclaimer, the term of this patent is extended or adjusted under 35 U.S.C. 154(b) by 0 days.

(21) Appl. No.: 16/435,588

(22) Filed: Jun. 10, 2019

(65) Prior Publication Data

US 2019/0375122 A1 Dec. 12, 2019

Related U.S. Application Data

(60) Provisional application No. 62/684,183, filed on Jun. 12, 2018.

(51) Int. Cl.
*B26B 21/22* (2006.01)

(52) U.S. Cl.
CPC ..... *B26B 21/227* (2013.01); *B26B 21/225* (2013.01)

(58) Field of Classification Search
CPC .... B26B 21/227; B26B 21/222; B26B 21/225
USPC ..... 30/50
See application file for complete search history.

(56) References Cited

U.S. PATENT DOCUMENTS 4,213,240 A * 7/1980 Ferraro ..... B26B 21/222 30/47
4,501,066 A * 2/1985 Sceberras ..... B26B 21/52 30/47
4,791,724 A * 12/1988 Dumas ..... B26B 21/18 30/48
5,865,189 A * 2/1999 Andrews ..... B26B 21/00 132/200
6,082,007 A * 7/2000 Andrews ..... B26B 21/00 30/47
6,161,288 A 12/2000 Andrews et al.
6,434,828 B1 * 8/2002 Andrews ..... B26B 21/00 30/50
8,096,054 B2 * 1/2012 Denkert ..... B26B 21/225 30/50
D731,119 S * 6/2015 Daniel ..... D28/46
9,233,476 B2 * 1/2016 Clemons ..... B26B 21/52
9,259,846 B1 * 2/2016 Robertson ..... B26B 21/523
9,327,415 B1 * 5/2016 Hovsepian ..... B26B 21/522
D819,273 S 5/2018 Cabrera et al.
2003/0033717 A1 * 2/2003 Cecil ..... B26B 21/22 30/50
2004/0231161 A1 * 11/2004 Coffin ..... B26B 21/4006 30/50
2006/0080839 A1 * 4/2006 Hesketh ..... B26B 21/4012 30/50
2006/0277769 A1 * 12/2006 Coffin ..... B26B 21/4006 30/527

(Continued)

*Primary Examiner* — Hwei-Siu C Payer
(74) *Attorney, Agent, or Firm* — Ashok Tankha; Lipton Weinberger & Husick

(57) ABSTRACT

A shaving apparatus including a handle and a cartridge connected to an upper end of the handle is provided. The cartridge includes at least two sub-cartridges connected to each other in a rigid connection or a detachable connection. Each of the sub-cartridges includes one or more blades extending outwardly at an acute angle relative to a face of the sub-cartridge and projecting generally away from a central longitudinal axis of the cartridge. The blades of a first of the two sub-cartridges are parallel to the blades of a second of the two sub-cartridges and positioned in a direction that opposes a direction of the blades of the second of the two sub-cartridges.

9 Claims, 18 Drawing Sheets

(56) References Cited

U.S. PATENT DOCUMENTS

| | | | | |
|---|---|---|---|---|
| 2010/0263220 | A1* | 10/2010 | Bruno | B26B 21/225 30/531 |
| 2010/0281698 | A1* | 11/2010 | King | B26B 21/225 30/527 |
| 2011/0016734 | A1* | 1/2011 | Kludjian | B26B 21/522 30/526 |
| 2013/0081276 | A1* | 4/2013 | Wain | B26B 21/521 30/42 |
| 2014/0245612 | A1* | 9/2014 | Good | B26B 21/4012 30/41 |
| 2019/0224874 | A1* | 7/2019 | Blatter | B26B 21/225 |
| 2019/0270211 | A1* | 9/2019 | Harris, II | B26B 21/521 |
| 2019/0375122 | A1* | 12/2019 | Appiah | B26B 21/227 |

* cited by examiner

SHAVING APPARATUS

CROSS-REFERENCE TO RELATED APPLICATIONS

This application claims priority to and the benefit of the provisional patent application titled "Shaving Apparatus", application No. 62/684,183, filed in the United States Patent and Trademark Office on Jun. 12, 2018. The specification of the above referenced patent application is incorporated herein by reference in its entirety.

BACKGROUND

The apparatus disclosed herein, in general, relates to a shaving apparatus. More particularly, the apparatus disclosed herein relates to a disposable razor cartridge comprising blades positioned in opposing directions on at least two sub-cartridges connected to each other in a rigid connection, or a detachable connection on an upper end of a handle.

Safety razors and shaving implements were initially made for the purpose of reducing the skill required for injury-free shaving, thereby eliminating the everyday need for a professional barber. As such, several designs have been made over the years to improve the ease of use of shaving implements. From the initial single blade straight edge safety razor design of the $18^{th}$ century to the more recent triple blade or four blade razor cartridge design, the contemporary razor has undergone several design changes resulting in improved ergonomics, reduced injury risk, and enhanced ease of use.

Conventional safety razor cartridges comprise a cartridge, a guard member, a handle, and lubricating strips or elastomeric members. The guard member protects the blade and a user from accidental cuts when the razor is not being used. The lubricating strips or elastomeric members deform when contacting the skin of the user. The cartridge is provided with two or more sets of blades that are restrained using retaining clips. However, the two or more sets of blades included in most safety razor cartridges are unidirectional, for example, angled downward relative to the cartridge. Such a design permits a user to only shave in a single direction necessitating additional maneuvering of the handle, for example, flipping the handle and/or twisting the handle, to shave in an opposing direction, thereby reducing ease of use. A shaving implement, which is designed to allow a user to shave in multiple directions, is therefore desired.

Hence, there is a long felt but unresolved need for a shaving apparatus, which is designed to allow a user to shave in multiple directions without requiring any additional maneuvering of the handle of the shaving apparatus.

SUMMARY OF THE INVENTION

This summary is provided to introduce a selection of concepts in a simplified form that are further disclosed in the detailed description of the invention. This summary is not intended to identify key or essential inventive concepts of the claimed subject matter, nor is it intended for determining the scope of the claimed subject matter.

Several embodiments of the apparatus disclosed address the above recited need for a shaving apparatus that allows a user to shave in multiple directions without requiring any additional maneuvering of the handle of the shaving apparatus.

According to one embodiment of the present disclosure, a shaving apparatus including a handle and a cartridge connected to an upper end of the handle is provided. The cartridge includes at least two sub-cartridges connected to each other in a rigid connection or a detachable connection. Each of the sub-cartridges includes one or more blades extending outwardly at an acute angle relative to a face of the sub-cartridge and projecting generally away from a central longitudinal axis of the cartridge. The blades of a first of the two sub-cartridges are parallel to the blades of a second of the two sub-cartridges and positioned in a direction that opposes a direction of the blades of the second of the two sub-cartridges.

In an embodiment of the present disclosure, the shaving apparatus comprises a handle and a cartridge connected to an upper end of the handle. The cartridge is oriented substantially collinear to a longitudinal axis of the handle and includes at least two sub-cartridges connected to each other in a rigid connection, or a detachable connection. Each of the sub-cartridges includes one or more blades extending outwardly at an acute angle relative to a face of the sub-cartridge and projecting generally away from a central longitudinal axis of the cartridge. The blades of a first of the two sub-cartridges are parallel to the blades of a second of the two sub-cartridges and positioned in a direction that opposes a direction of the blades of the second of the two sub-cartridges.

BRIEF DESCRIPTION OF THE DRAWINGS

The foregoing summary, as well as the following detailed description of the invention, is better understood when read in conjunction with the appended drawings. For the purpose of illustrating the invention, exemplary constructions of the invention are shown in the drawings. However, the invention is not limited to the specific methods and structures disclosed herein. The description of a method step or a structure referenced by a numeral in a drawing is applicable to the description of that method step or structure shown by that same numeral in any subsequent drawing herein.

DETAILED DESCRIPTION OF THE INVENTION

Shaving apparatuses, for example, safety razors generally refer to shaving implements that contain a handle and a shaving head assembly. The shaving head assembly comprises designs having a single blade to ones having four or five blades that are spaced apart. Because the blade used in a shaving apparatus is small, a support structure configured to restrain movement of the blade is required. The support structure includes a simple screw thread fastener in combination with a cap member or a more complex assembly containing multiple blade support members and retaining clips. As used herein, the shaving head assembly comprising a set of blades and its corresponding support structure is referred to as a "sub-cartridge". Furthermore, two or more "sub-cartridges" either detachably or rigidly connected to each other are collectively referred to as a "cartridge".

Figure 1A:
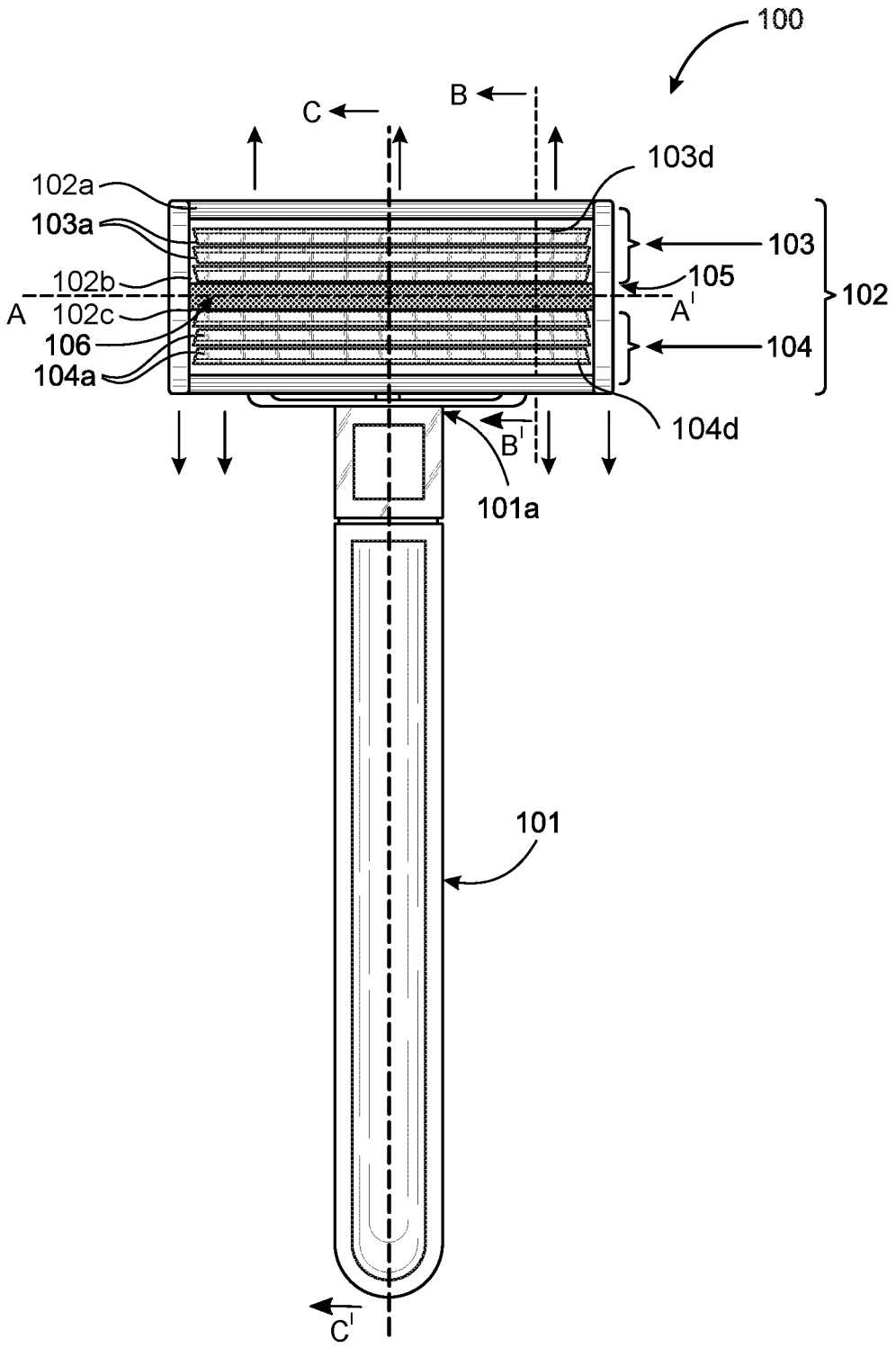
FIG. 1A exemplarily illustrates a front elevation view of a shaving apparatus.
Figure 9A:
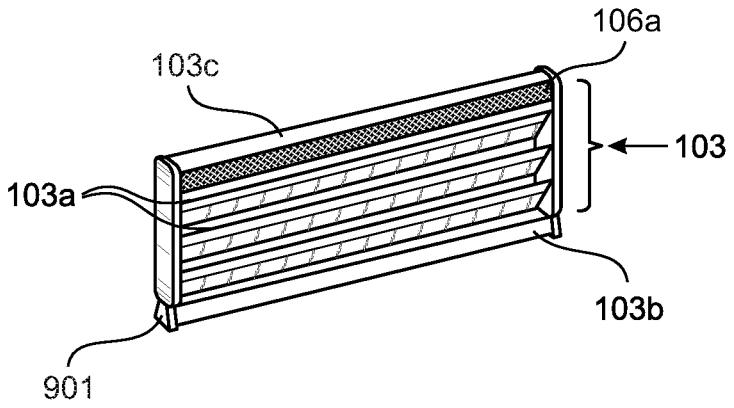
FIG. 9A exemplarily illustrates a top left from side perspective view of a first sub-cartridge detached from a second sub-cartridge of the embodiment of the shaving apparatus shown in FIGS. 7-8, showing a tapered sliding dovetail male tongue as elements of a sliding dovetail joint.
Figure 9B:
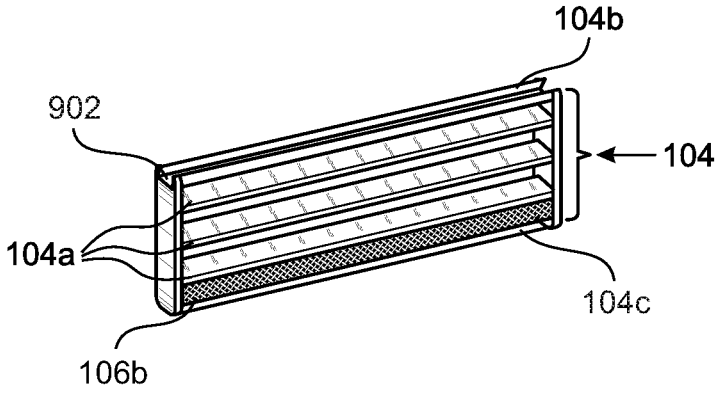
FIG. 9B exemplarily illustrates a top left front side perspective view of a second sub-cartridge detached from a first sub-cartridge of the embodiment of the shaving apparatus shown in FIGS. 7-8, showing a tapered sliding dovetail female groove as elements of a sliding dovetail joint.

FIG. 1A exemplarily illustrates a front elevation view of a shaving apparatus 100. The shaving apparatus 100 comprises a handle 101 and a cartridge 102 connected to an upper end 101*a* of the handle 101. In an embodiment, the cartridge 102 is rigidly connected to the upper end 101*a* of the handle 101. In another embodiment, the cartridge 102 is detachably connected to the upper end 101*a* of the handle 101, for example, using fasteners such as buttons, buckles, latches, snap fasteners, etc. Additionally, the cartridge 102 is oriented substantially perpendicular to the handle 101. In an embodiment, the handle 101 is extrusion molded from semi-rigid polymeric materials that do not wear under normal shaving conditions, for example, a blend of polyphenylene oxide (PPO) and polystyrene, high impact polystyrene, polypropylene, ABS, polytetrafluoroethylene (PTFE), high density polyethylene (HPDE), acetal, nylon, or any combination thereof. In an embodiment, the polymeric material is filled with materials such as silicone, molidium disulfide, or other lubricating agents known to those skilled in the art for reducing friction against the surface of the skin. Although a longitudinal axis A-A' of the cartridge 102 is shown positioned substantially perpendicular to a longitudinal axis C-C' of the handle 101, in other embodiments, as exemplarily illustrated in FIGS. 13A-14B, the cartridge 102 is oriented substantially parallel relative to the handle 101 for improving flexibility, maneuverability, or providing an ergonomic design to the shaving apparatus 100. In another embodiment, the cartridge 102 is detachably connected to the upper end 101*a* of the handle 101, for example, by a bridle joint, a mortise and tenon joint, a finger joint, a dovetail joint, etc. As exemplarily illustrated in FIG. 1A, the cartridge 102 comprises at least two sub-cartridges, namely, a first sub-cartridge 103 and a second sub-cartridge 104 rigidly connected to each other, thereby creating a 2-in-1 cartridge 102. In an embodiment, the first sub-cartridge 103 comprises a first long side 103*b* and a second long side 103*c* opposite to the first long side 103*b*, as illustrated in FIG. 9A. Similarly, the second sub-cartridge 104 comprises a first long side 104*b* and a second long side 104*c* opposite to the first long side 104*b*, as illustrated in FIG. 9B. The cartridge 102 further comprises one or more guard members 102*a* configured to prevent accidental cuts to a user's skin during use. For example, both the first sub-cartridge 103 and the second sub-cartridge 104 comprise a guard member 102*a* positioned on the second long side 103*c* of the first sub-cartridge 103 and on the second long side 104*c* of the second sub-cartridge 104.

The first sub-cartridge 103 comprises one or more blades 103*a*, for example, two blades, and the second sub-cartridge 104 comprises one or more blades 104*a*, for example, two blades. In an embodiment, the blades 103*a*, 104*a* of the first and second sub-cartridges 103, 104 are manufactured using a suitable blade manufacturing process. Blade manufacturing processes are well known in the industry which comprise melting steel, pouring the steel to produce flat rolled coil, annealing the steel, and sharpening the coil edges. Annealing comprises heating the coil to temperatures ranging between 1,967-2,048° F. (1,075-1,120° C.) and subsequently quenching it in water to a temperature between −76-−112° F. (−60-−80° C.) to harden it. Next, the quenched steel is tempered at a temperature ranging between (482-752° F. (250-400° C.). The blades 103*a*, 104*a* are then die stamped to form an appropriate shape. In an embodiment, the blades 103*a*, 104*a* are about 1.5 inches (3.81 cm) wide and about 3 mm deep. The blades 103*a* and 104*a* comprise cutting edges 103*d* and 104*d*, respectively, as illustrated in FIG. 1A. The cutting edge 104*d* is adapted to cut hair that is pressed against the cutting edge 104*d* when the user shaves a portion of his/her face using a downward motion of the shaving apparatus 100. Similarly, the cutting edge 103*d* is adapted to cut hair that is pressed against the cutting edge 103*d* when the user shaves a portion of his/her face using am upward motion of the shaving apparatus 100. In an embodiment, the cutting edges 103*d*, 104*d* of each of the blades 103*a*, 104*a* is about 1 mm deep.

Figure 1B:
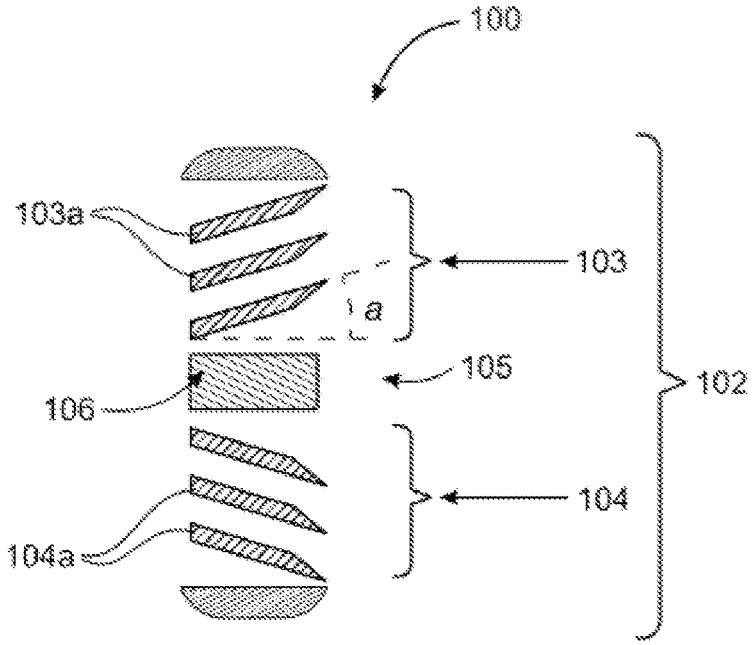
FIG. 1B exemplarily illustrates a cross-sectional view of a cartridge of the shaving apparatus shown in FIG. 1A.

In an embodiment, the first and the second sub-cartridges 103, 104 comprises one or more blades 103*a*, 104*a* respectively. Further, as shown in FIG. 1B, the blades 103*a*, 104*a* extend outwardly at an acute angle "a", relative to a corresponding face 102*b*, 102*c* of the sub-cartridge and project generally away from a central longitudinal axis A-A' of the cartridge 102. The blades 103*a* of the first sub-cartridge 103 are parallel to the blades 104*a* of the second sub-cartridge 104. Furthermore, the blades 103*a* of the first sub-cartridge 103 are positioned in a direction that opposes a direction of the blades 104*a* of the second sub-cartridge 104. A center portion 105 of the cartridge 102 is parallel to the blades 103*a* of the first sub-cartridge 103 and the blades 104*a* of the second sub-cartridge 104. The shaving apparatus 100 further comprises a lubricating strip 106 illustrated in FIG. 2 positioned on the center portion 105 of the cartridge 102 between the first sub-cartridge 103 and the second sub-cartridge 104. In an embodiment, the lubricating strip 106 includes a shaving aid, which provides, for example, lubricity, skin moisturizing and conditioning properties, and the like. The oppositely positioned blades 103*a* and 104*a* of the first sub-cartridge 103 and the second sub-cartridge 104 respectively, of the shaving apparatus 100 allow a user to shave, for example, hair on a body part, for example, face, hands, legs, etc., in opposing directions. For example, the user shaves a portion of his/her face using a downward motion of the shaving apparatus 100 during which the blades 104*a* of the second sub-cartridge 104 cut hair from the face that contact blades 104*a*. Alternatively, in an example, when the user moves the shaving apparatus 100 in an upward direction, the blades 103*a* of the first sub cartridge 103 cuts hair from the face that contact blades 103*a*.

FIG. 1B exemplarily illustrates a cross-sectional view of a cartridge 102 of the shaving apparatus shown in FIG. 1A. As disclosed in the detailed description of FIG. 1A, the first and the second sub-cartridges 103, 104 comprise one or more blades 103*a*, 104*a* respectively. Further, the blades 103*a*, 104*a* are oriented such that the blades 103*a*, 104*a* of the cartridge 102 extend outwardly at an acute angle relative to a corresponding face 102*b*, 102*c* of the sub-cartridge and project generally away from a central longitudinal axis A-A' of the cartridge 102.

Figure 2:
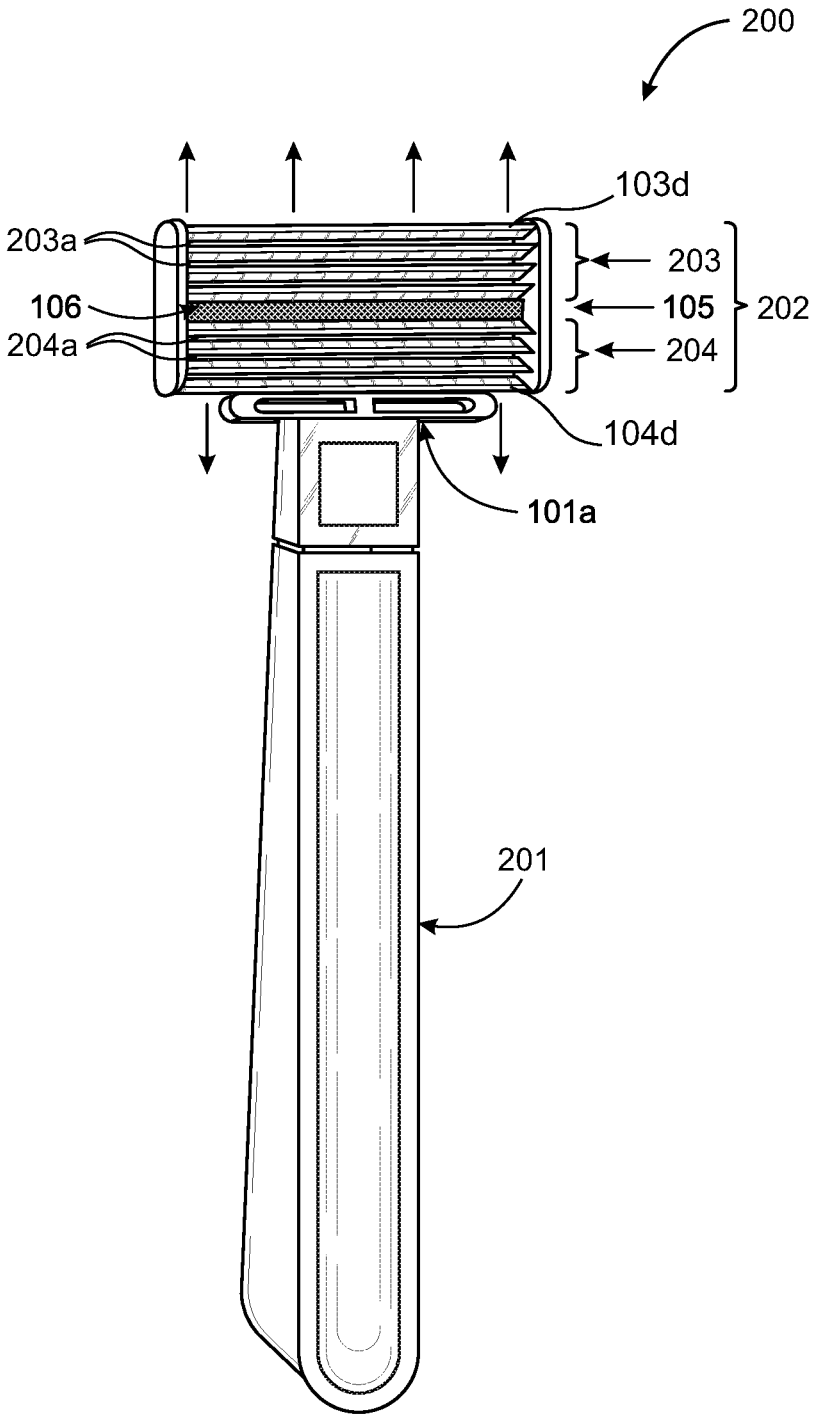
FIG. 2 exemplarily illustrates a front perspective view of an embodiment of the shaving apparatus.

FIG. 2 exemplarily illustrates a front perspective view of an embodiment of the shaving apparatus 200. In this embodiment, the shaving apparatus 200 comprises a handle 201 having a structure that is different from the handle 101 exemplarily illustrated in FIG. 1A. Furthermore, in this embodiment, the shaving apparatus 200 further comprises a cartridge 202 having a structure that is different from the cartridge 102 exemplarily illustrated in FIG. 1A. The cartridge 202 is connected to the upper end 101*a* of the handle 201 of the different structure as disclosed in the detailed description of FIG. 1A. The cartridge 202 comprises the first sub-cartridge 203, the second sub-cartridge 204, and the lubricating strip 106 positioned on the center portion 105 of the cartridge 202 as disclosed in the detailed description of FIG. 1A. The first sub-cartridge 203 and the second sub-cartridge 204 comprise blades 203*a* and 204*a* respectively, positioned in opposing directions as disclosed in the detailed description of FIG. 1A.

Figure 3:
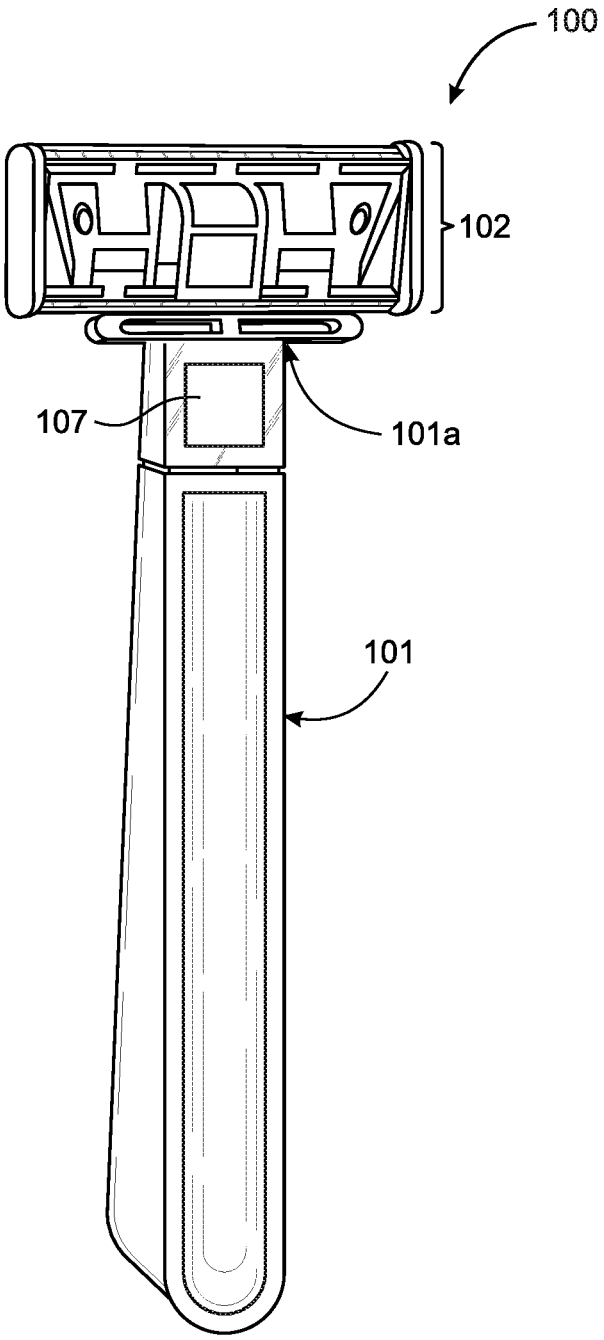
FIG. 3 exemplarily illustrates a rear perspective view of the shaving apparatus.

FIG. 3 exemplarily illustrates a rear perspective view of the shaving apparatus 100. In an embodiment, the shaving apparatus 100 further comprises a button 107 positioned proximal to the upper end 101*a* of the handle 101 for detaching the cartridge 102 from the upper end 101*a* of the handle 101.

Figure 4:
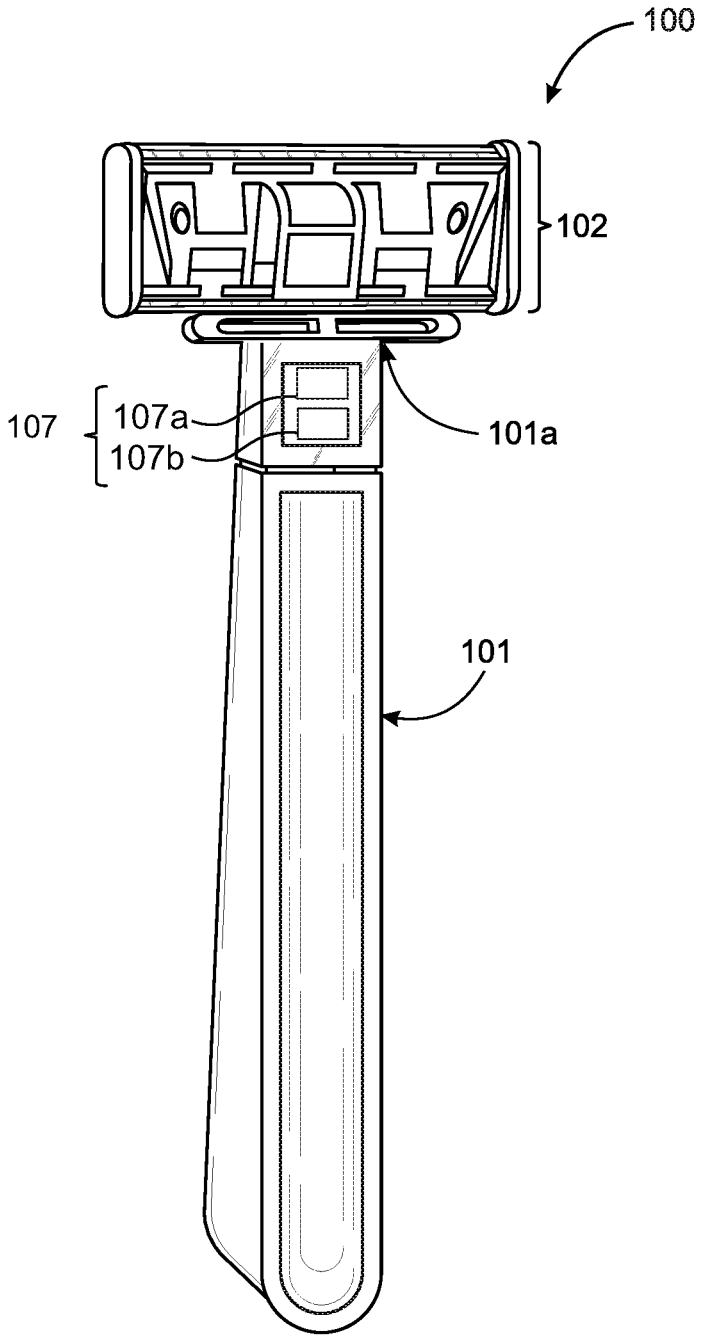
FIG. 4 exemplarily illustrates a rear perspective view of an embodiment of the shaving apparatus.

FIG. 4 exemplarily illustrates a rear perspective view of an embodiment of the shaving apparatus 100. In this embodiment, the shaving apparatus 100 includes a two button 107 mechanism positioned proximal to the upper end 101*a* of the handle 101 for detaching a corresponding sub-cartridge 103, 104 (exemplarily illustrated in FIG. 2) of the cartridge 102 from the upper end 101*a* of the handle 101. For example, a first button 107*a* of the two-button mechanism 107 is configured to detach a first sub-cartridge 103 and a second button 107*b* of the two-button mechanism 107 is configured to detach a second sub-cartridge 104 of the cartridge 102.

Figure 5A:
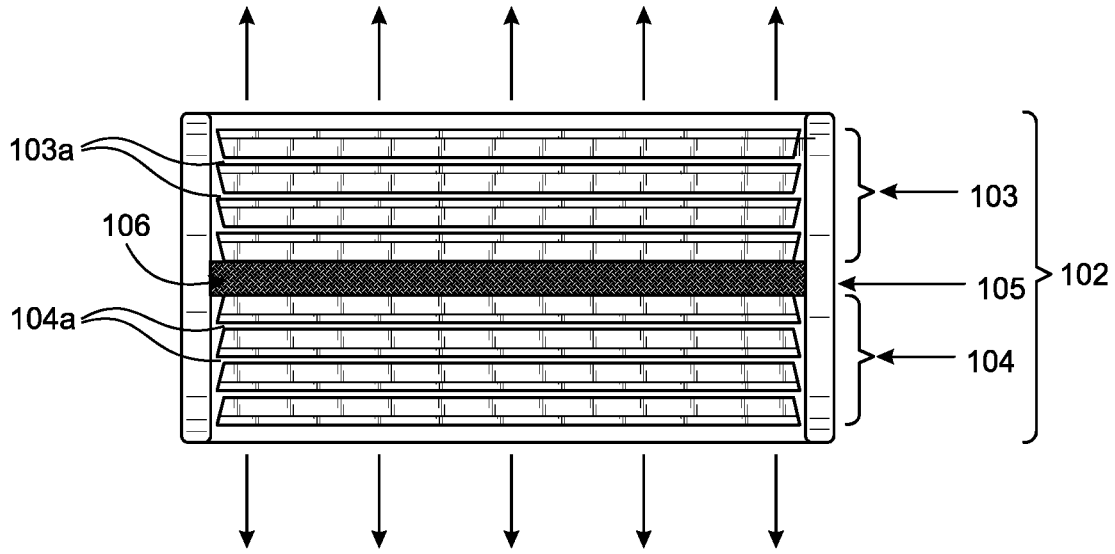
FIG. 5A exemplarily illustrates a front elevation view of a cartridge.

FIG. 5A exemplarily illustrates a front elevation view of the cartridge 102 of the shaving apparatus 100 exemplarily illustrated in FIG. 1A. The cartridge 102 comprises the first sub-cartridge 103 and the second sub-cartridge 104 rigidly connected to each other. Four blades 103*a* are mounted on the first sub-cartridge 103 and four blades 104*a* are mounted on the second sub-cartridge 104. The blades 103*a* of the first sub-cartridge 103 and the blades 104*a* of the second sub-cartridge 104 face outwardly with respect to the center portion 105 of the cartridge 102. The direction of the blades 103*a* of the first sub-cartridge 103 are in a direction opposite to the blades 104*a* of the second sub-cartridge 104. For example, the blades 103*a* of the first sub-cartridge 103 are positioned to face outwardly in an upward direction, while the blades 104*a* of the second sub-cartridge 104 are positioned to face outwardly in a downward direction as exemplarily illustrated in FIG. 5A. The lubricating strip 106 is positioned on the center portion 105 of the cartridge 102 between the first sub-cartridge 103 and the second sub-cartridge 104.

Figure 5B:
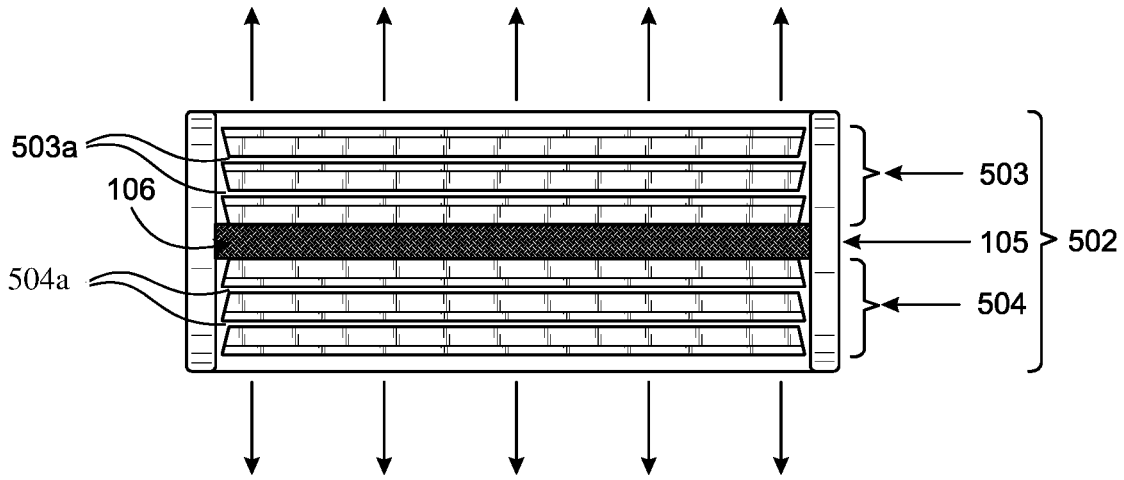
FIG. 5B exemplarily illustrates a front elevation view of an embodiment of the cartridge.

FIG. 5B exemplarily illustrates a front elevation view of an embodiment of the cartridge 502. The structure of the cartridge 502 exemplarily illustrated in FIG. 5B, is different from the structure of the cartridge 102 exemplarily illustrated in FIG. 5A. The cartridge 502 comprises the first sub-cartridge 503 and the second sub-cartridge 504 connected to each other in a rigid connection as disclosed in the detailed description of FIG. 1A and FIG. 5A. In this embodiment, three blades 503*a* are mounted on the first sub-cartridge 503 and three blades 504*a* are mounted on the second sub-cartridge 504.

FIGS. 6A-6H exemplarily illustrate front elevation views of different embodiments of the cartridge 602. The cartridge 602 comprises two sub-cartridges, namely, the first sub-cartridge 603 and the second sub-cartridge 604 connected to each other in a rigid connection. In an embodiment as exemplarily illustrated in FIG. 6A, the first sub-cartridge 603 comprises two blades 603*a* and the second sub-cartridge 604 comprises two blades 604*a*. The double blade 603*a* of the first sub-cartridge 603 and the double blade 604*a* of the second sub-cartridge 604 are positioned angularly to face outwardly with respect to the center portion 605 of the cartridge 602. The double blade 603*a* of the first sub-cartridge 603 is positioned in a direction that opposes the direction of the double blade 604*a* of the second sub-cartridge 604. For example, the double blade 603*a* of the first sub-cartridge 603 is positioned to face outwardly in an upward direction, while the double blade 604*a* of the second sub-cartridge 604 is positioned to face outwardly in a downward direction as exemplarily illustrated in FIG. 6A.

Figure 6A:
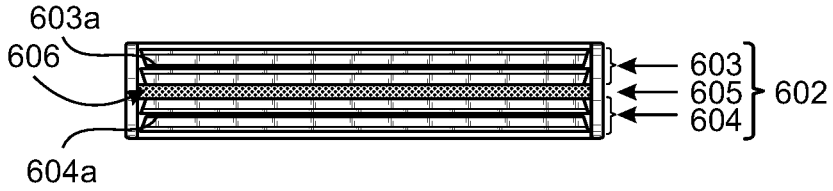
FIGS. 6A-6H exemplarily illustrate front elevation views of different embodiments of the cartridge.
Figure 6B:
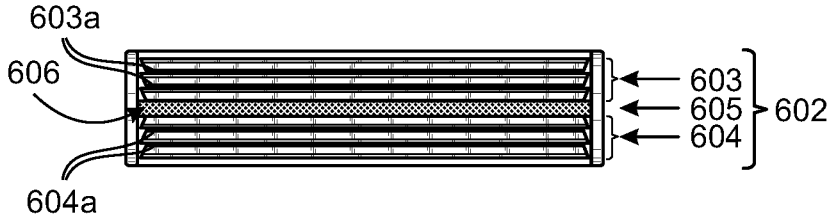

In another embodiment as exemplarily illustrated in FIG. 6B, the first sub-cartridge 603 comprises three blades 603*a* and the second sub-cartridge 604 comprises three blades 604*a*. The three blades 603*a* of the first sub-cartridge 603 and the three blades 604*a* of the second sub-cartridge 604 are oriented to face outwardly with respect to the center portion 605 of the cartridge 602. The three blades 603*a* of the first sub-cartridge 603 are positioned in a direction that opposes the direction of the three blades 604*a* of the second sub-cartridge 604. For example, the three blades 603*a* of the first sub-cartridge 603 are positioned to face outwardly in an upward direction, while the three blades 604*a* of the second sub-cartridge 604 are positioned to face outwardly in a downward direction as exemplarily illustrated in FIG. 6B.

Figure 6C:
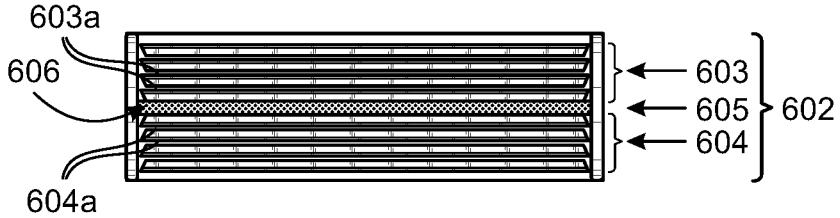

In another embodiment as exemplarily illustrated in FIG. 6C, the first sub-cartridge 603 comprises four blades 603*a* and the second sub-cartridge 604 comprises four blades 604*a*. The four blades 603*a* of the first sub-cartridge 603 and the four blades 604*a* of the second sub-cartridge 604 are oriented to face outwardly with respect to the center portion 605 of the cartridge 602. The four blades 603*a* of the first sub-cartridge 603 are positioned in a direction that opposes the direction of the four blades 604*a* of the second sub-cartridge 604. For example, the four blades 603*a* of the first sub-cartridge 603 are positioned to face outwardly in an upward direction, while the four blades 604*a* of the second sub-cartridge 604 are positioned to face outwardly in a downward direction as exemplarily illustrated in FIG. 6C.

Figure 6D:
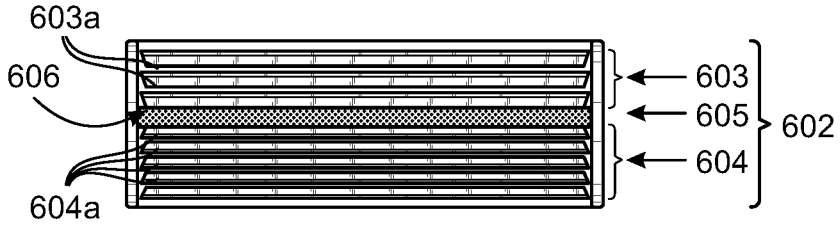

In another embodiment as exemplarily illustrated in FIG. 6D, the first sub-cartridge 603 comprises three blades 603*a* and the second sub-cartridge 604 comprises five blades 604*a*. The three blades 603*a* of the first sub-cartridge 603 and the five blades 604*a* of the second sub-cartridge 604 are oriented to face outwardly with respect to the center portion 605 of the cartridge 602. The three blades 603*a* of the first sub-cartridge 603 are positioned in a direction that opposes the direction of the five blades 604*a* of the second sub-cartridge 604. For example, the three blades 603*a* of the first sub-cartridge 603 are positioned to face outwardly in an upward direction, while the five blades 604*a* of the second sub-cartridge 604 are positioned to face outwardly in a downward direction as exemplarily illustrated in FIG. 6D.

Figure 6E:
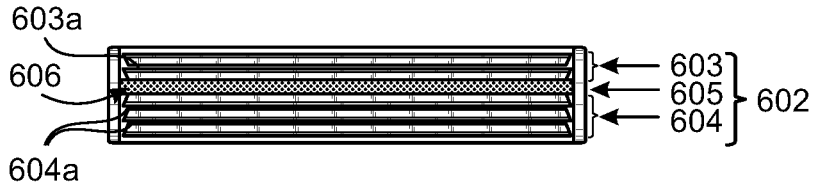

In another embodiment as exemplarily illustrated in FIG. 6E, the first sub-cartridge 603 comprises two blade 603*a* and the second sub-cartridge 604 comprises three blades 604*a*. The two blade 603*a* of the first sub-cartridge 603 and the three blades 604*a* of the second sub-cartridge 604 are oriented to face outwardly with respect to the center portion 605 of the cartridge 602. The two blade 603*a* of the first sub-cartridge 603 is positioned in a direction that opposes the direction of the three blades 604*a* of the second sub-cartridge 604. For example, the two blade 603*a* of the first sub-cartridge 603 is positioned to face outwardly in an upward direction, while the three blades 604*a* of the second sub-cartridge 604 are positioned to face outwardly in a downward direction as exemplarily illustrated in FIG. 6E.

Figure 6F:
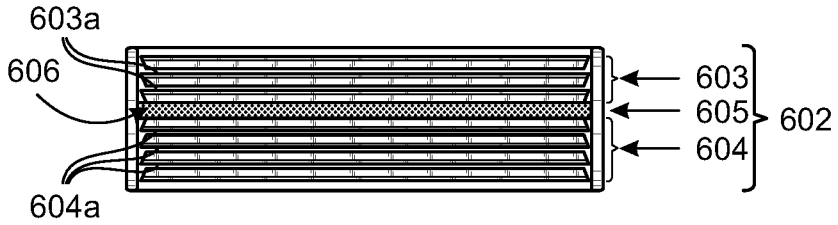

In another embodiment as exemplarily illustrated in FIG. 6F, the first sub-cartridge 603 comprises three blades 603*a* and the second sub-cartridge 604 comprises four blades 604*a*. The three blades 603*a* of the first sub-cartridge 603 and the four blades 604*a* of the second sub-cartridge 604 are oriented to face outwardly with respect to the center portion 605 of the cartridge 602. The three blades 603*a* of the first sub-cartridge 603 are positioned in a direction that opposes the direction of the three blades 604*a* of the second sub-cartridge 604. For example, the three blades 603*a* of the first sub-cartridge 603 are positioned to face outwardly in an upward direction, while the four blades 604*a* of the second sub-cartridge 604 are positioned to face outwardly in a downward direction as exemplarily illustrated in FIG. 6F.

Figure 6G:
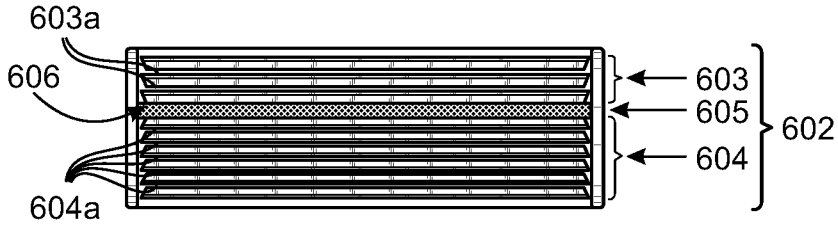

In another embodiment as exemplarily illustrated in FIG. 6G, the first sub-cartridge 603 comprises three blades 603*a* and the second sub-cartridge 604 comprises six blades 604*a*. The three blades 603*a* of the first sub-cartridge 603 and the six blades 604*a* of the second sub-cartridge 604 are oriented to face outwardly with respect to the center portion 605 of the cartridge 602. The three blades 603*a* of the first sub-cartridge 603 are positioned in a direction that opposes the direction of the six blades 604*a* of the second sub-cartridge 604. For example, the three blades 603*a* of the first sub-cartridge 603 are positioned to face outwardly in an upward direction, while the six blades 604*a* of the second sub-cartridge 604 are positioned to face outwardly in a downward direction as exemplarily illustrated in FIG. 6G.

Figure 6H:
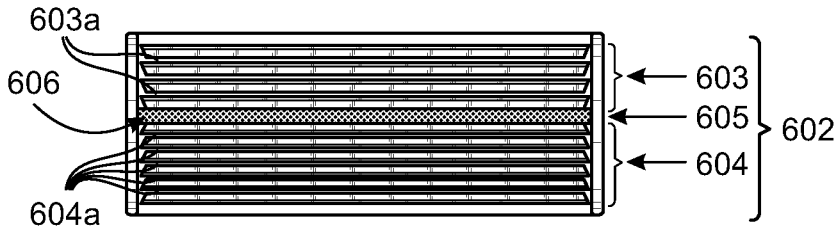

In another embodiment as exemplarily illustrated in FIG. 6H, the first sub-cartridge 603 comprises four blades 603*a* and the second sub-cartridge 604 comprises six blades 604*a*. The four blades 603*a* of the first sub-cartridge 603 and the six blades 604*a* of the second sub-cartridge 604 are oriented to face outwardly with respect to the center portion 605 of the cartridge 602. The four blades 603*a* of the first sub-cartridge 603 are positioned in a direction that opposes the direction of the six blades 604*a* of the second sub-cartridge 604. For example, the four blades 603*a* of the first sub-cartridge 603 are positioned to face outwardly in an upward direction, while the six blades 604*a* of the second sub-cartridge 604 are positioned to face outwardly in a downward direction as exemplarily illustrated in FIG. 6H.

Figure 7:
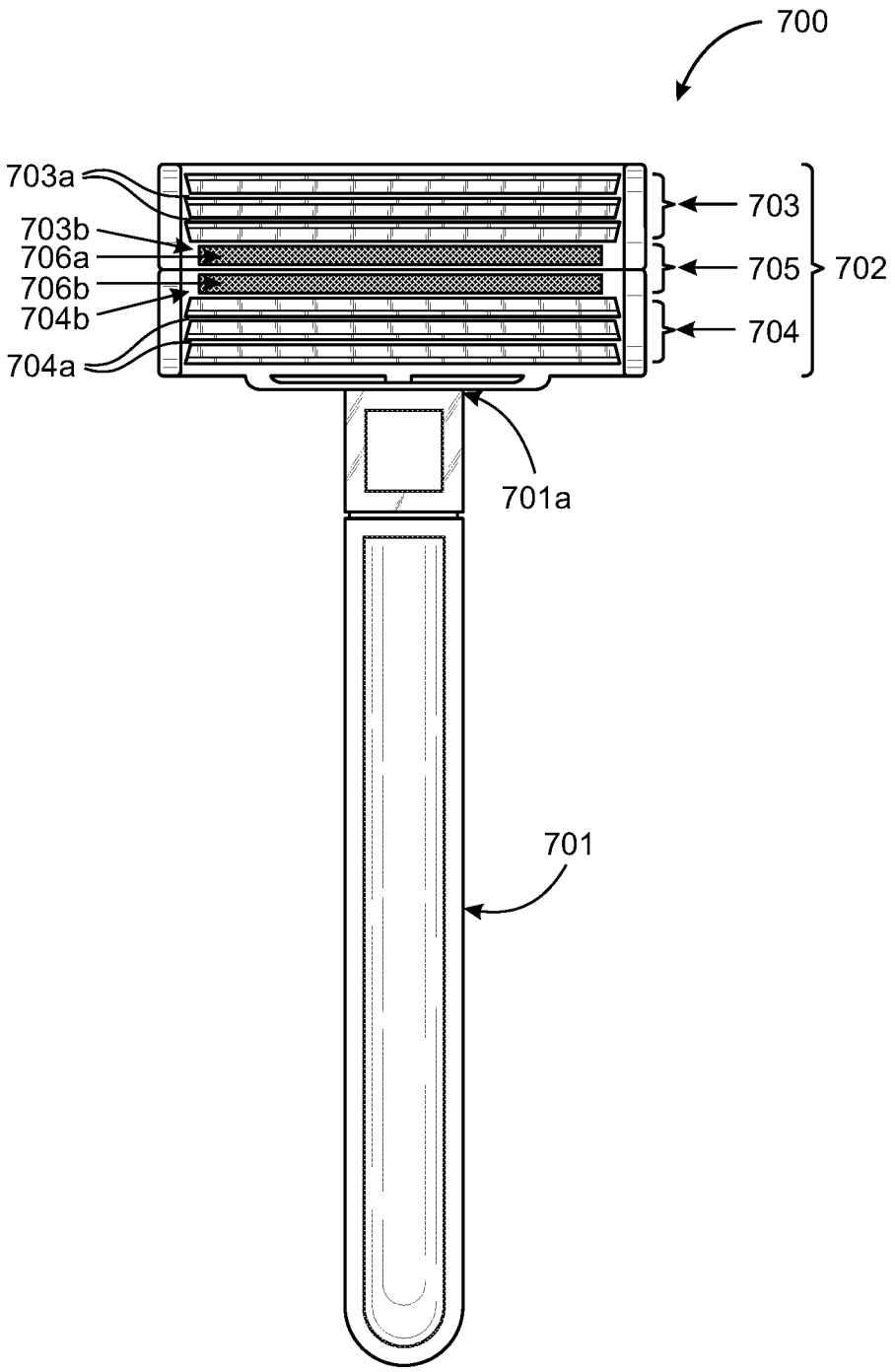
FIG. 7 exemplarily illustrates a front elevation view of an embodiment of the shaving apparatus.

FIG. 7 exemplarily illustrates a front elevation view of an embodiment of the shaving apparatus 700. The shaving apparatus 700 comprises a handle 701 and a cartridge 702 connected to an upper end 701*a* of the handle 701 as disclosed in the detailed description of FIG. 1A. In this embodiment, the cartridge 702 comprises at least two sub-cartridges, namely, a first sub-cartridge 703 and a second sub-cartridge 704 connected to each other in a detachable connection, thereby creating a 2-in-1 cartridge 702. In an embodiment, the first sub-cartridge 703 comprises a first long side 703*b* and a second long side 703*c* opposite to the first long side 703*b*. Similarly, the second sub-cartridge 704 comprises a first long side 704*b* and a second long side 704*c* opposite to the first long side 704*b*. Moreover, two separate lubricating strips 706*a*, 706*b* are provided on each sub-cartridge 703, 704 respectively. The lubricating strips 706*a*, 706*b* are positioned proximal to the center portion 705 of the cartridge 702.

Figure 8:
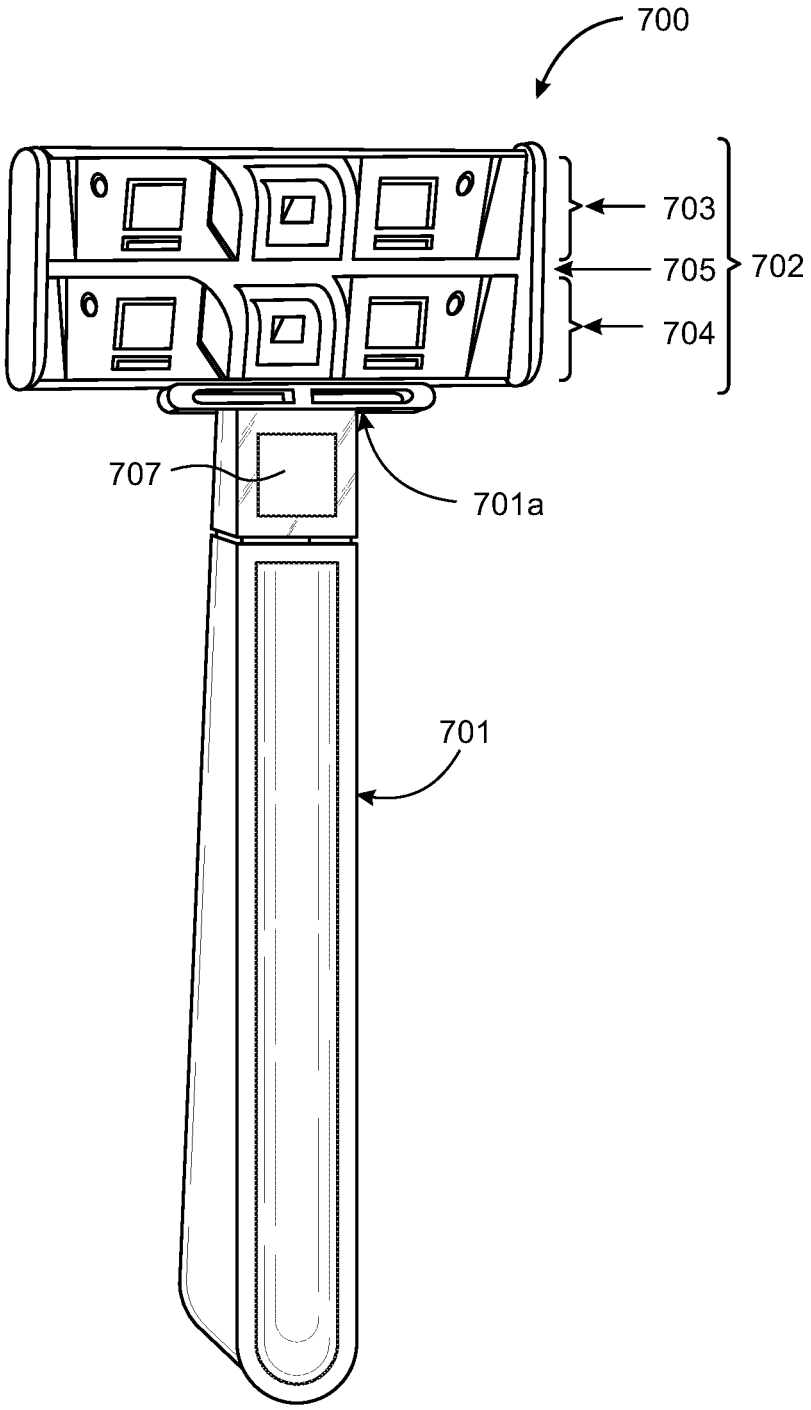
FIG. 8 exemplarily illustrates a rear perspective view of the embodiment of the shaving apparatus shown in FIG. 7.

FIG. 8 exemplarily illustrates a rear perspective view of the embodiment of the shaving apparatus shown in FIG. 7. In an embodiment, the shaving apparatus 700 further comprises a button 707 positioned proximal to the upper end 701*a* of the handle 701 for detaching the cartridge 702 from the upper end 701*a* of the handle 701.

FIG. 9A exemplarily illustrates a top left front side perspective view of the first sub-cartridge 103 detached from the second sub-cartridge 104 of the embodiment of the shaving apparatus 100 shown in FIGS. 7-8 showing a tapered sliding dovetail male tongue 901 as an element of a sliding dovetail joint. FIG. 9B exemplarily illustrates a top left front side perspective view of the second sub-cartridge 104 detached from the first sub-cartridge 103 of the embodiment of the shaving apparatus 100 shown in FIGS. 7-8 showing a tapered sliding dovetail female groove 902 as an element of a sliding dovetail joint. The first sub-cartridge 103 comprises a tapered sliding dovetail male tongue 901 located in the first long side 103*b* and the second sub-cartridge 104 comprises a tapered sliding dovetail female groove 902 located in the first long side 104*b*. The tapered sliding dovetail male tongue 901 of the first sub-cartridge 103 and the tapered sliding dovetail female groove 902 of the second sub-cartridge 104 together form a sliding dovetail joint, as illustrated in FIG. 7. The tapered sliding dovetail male tongue 901 comprises a narrow end 901*a* as illustrated in FIG. 9A. The tapered sliding dovetail male tongue 901 is inserted into the tapered sliding dovetail female groove 902, providing a tight fit of the sliding dovetail joint. The sliding dovetail joint restrains movement of the first sub-cartridges 103 when compared to the second sub-cartridge 104.

As illustrated in FIGS. 9A and 9B, the number of blades in the first and the second cartridges 103 and 104 are equal. The first sub-cartridge 103 comprises three blades 103*a* and the second sub-cartridge 104 comprises three blades 104*a*. The direction of the blades 103*a* of the first sub-cartridge 103 opposes the direction of the blades 104*a* of the second sub-cartridge 104. In this embodiment, the shaving apparatus 100 further comprises a lubricating strip 106*a* positioned on the second long side 103*c* of the first sub-cartridge 103, and a lubricating strip 106*b* positioned on the second long side 104*c* of the second sub-cartridge 104.

Upon attachment, the first sub-cartridge 103 and the second sub-cartridge 104 form the cartridge 102. The center portion 105 of the cartridge 102 between the first sub-cartridge 103 and the second sub-cartridge 104 comprises one or more lubricating strips 106*a* and 106*b*. In an embodiment, the lubricating strips 106*a* and 106*b* are positioned on a portion of the cartridge 102 other than the center portion 105 of the cartridge 102 constituted by the connection portion 901 of the first sub-cartridge 103 and the connection portion 902 of the second sub-cartridge 104. In an embodiment, a position of the lubricating strip 106*a* on the first sub-cartridge 103 differs from a position of the lubricating strip 106*b* on the second sub-cartridge 104. In an embodiment, the lubricating strips 106*a* and 106*b* are absent from the first sub-cartridge 103 and the second sub-cartridge 104. In another embodiment, at least one lubricating strip 106*a* or 106*b* is positioned on the first sub-cartridge 103 or the second sub-cartridge 104 respectively.

Figures 10A, 10B:
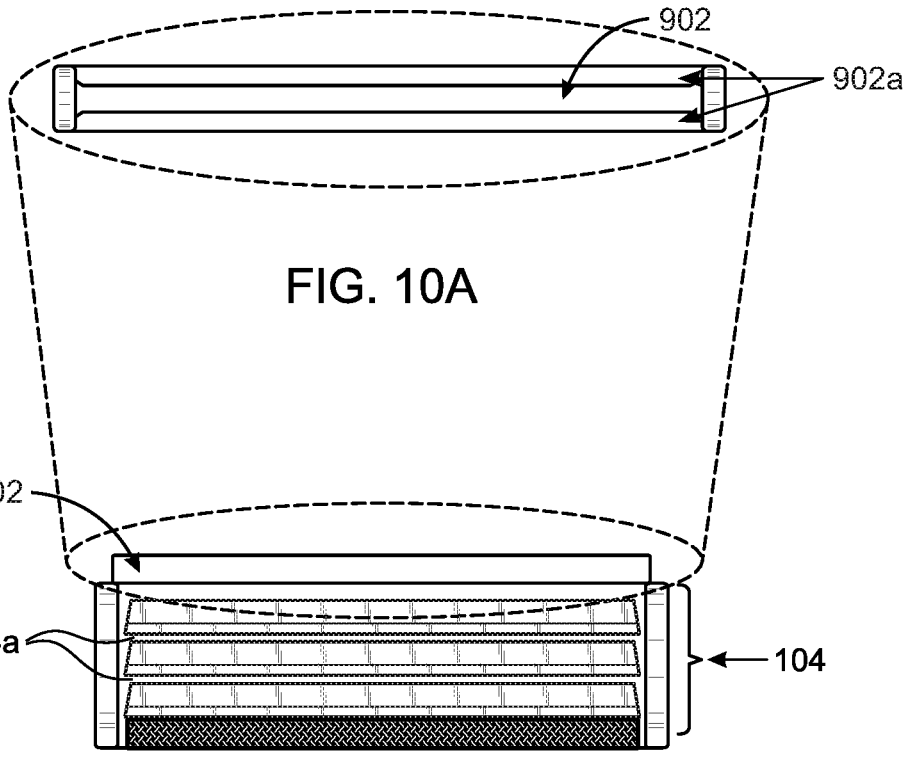
FIG. 10A exemplarily illustrates an enlarged view of a connection member of the second sub-cartridge of the embodiment of the shaving apparatus shown in FIGS. 7-8.
FIG. 10B exemplarily illustrates a front elevation view of the second sub-cartridge of the embodiment of the shaving apparatus shown in FIGS. 7-8.

FIG. 10A exemplarily illustrates an enlarged view of the tapered sliding dovetail female groove 902 located on the first long side 104*b* of the second sub-cartridge 104 of the embodiment of the shaving apparatus 100 shown in FIGS. 7-8. FIG. 10B exemplarily illustrates a front elevation view of the second sub-cartridge 104 of the embodiment of the shaving apparatus 100 shown in FIGS. 7-8.

Figures 11A, 11B:
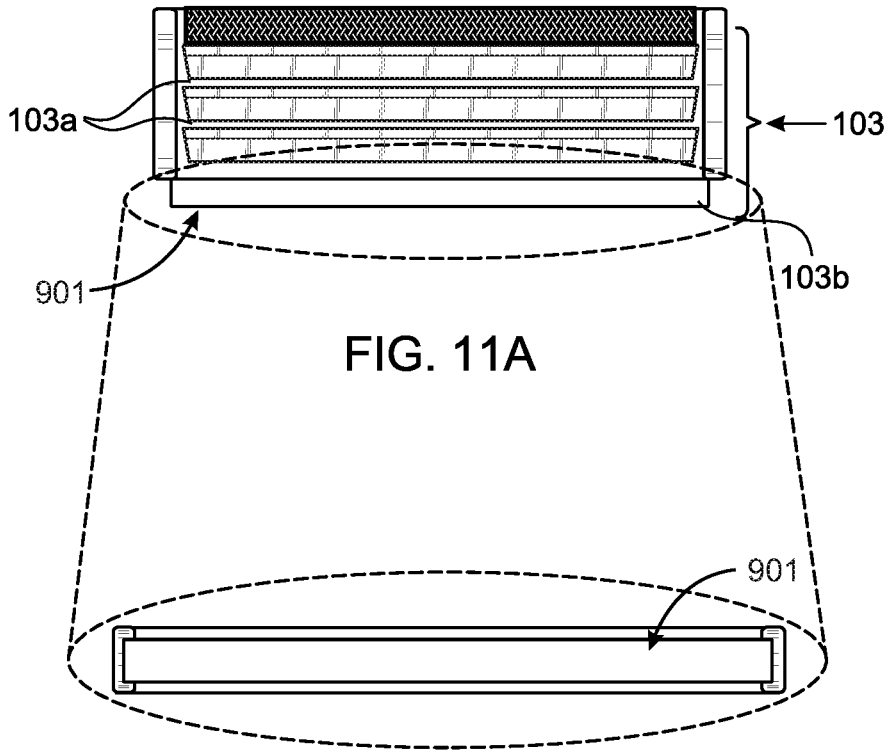
FIG. 11A exemplarily illustrates a front elevation view of the first sub-cartridge of the embodiment of the shaving apparatus shown in FIGS. 7-8, showing a tapered sliding dovetail male tongue of the first sub-cartridge configured to engage with the tapered sliding dovetail female groove of the second sub-cartridge.
FIG. 11B exemplarily illustrates an enlarged view of the tapered sliding dovetail male tongue of the first sub-cartridge of the embodiment of the shaving apparatus shown in FIGS. 7-8.

FIG. 11A exemplarily illustrates a front elevation view of the first sub-cartridge 103 of the embodiment of the shaving apparatus 100 shown in FIGS. 7-8, showing the tapered sliding dovetail male tongue 901 of the first sub-cartridge 103 configured to engage with the tapered sliding dovetail female groove 902 of the second sub-cartridge 104. FIG. 11B exemplarily illustrates an enlarged view of the tapered sliding dovetail male tongue 901 of the first sub-cartridge 103 of the embodiment of the shaving apparatus 100 shown in FIGS. 7-8. In an embodiment, the tapered sliding dovetail male tongue 901 is positioned on the first long side 103*b* of the first sub-cartridge 103 as exemplarily illustrated in FIG. 11A. In an embodiment, the tapered sliding dovetail male tongue 901 and the tapered sliding dovetail female groove 902 are interchangeably positioned on the second sub-cartridge 104 and first sub-cartridge 103, respectively.

Figure 12:
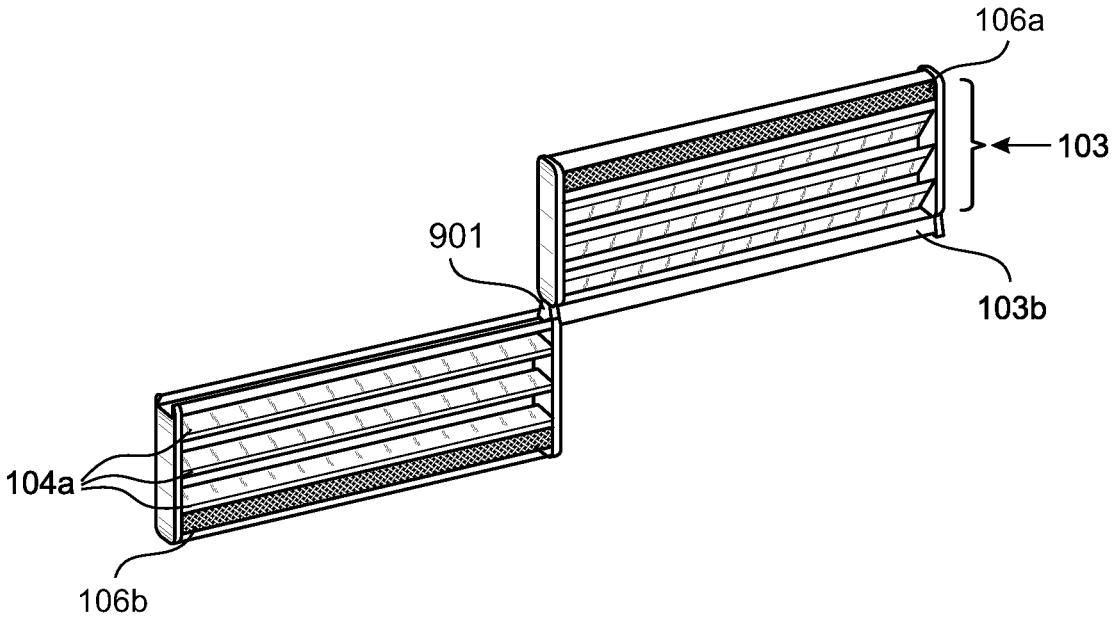
FIG. 12 exemplarily illustrates a top left front side perspective view showing engagement of the tapered sliding dovetail male tongue of the first sub-cartridge and the tapered sliding dovetail female groove of second sub-cartridge of the embodiment of the shaving apparatus shown in FIGS. 7-8.

FIG. 12 exemplarily illustrates a top left front side perspective view showing engagement of the tapered sliding dovetail male tongue 901 of the first sub-cartridge 103 and the tapered sliding dovetail female groove 902 of the second sub-cartridge 104 exemplarily illustrated in FIGS. 11A and 10B respectively, of the embodiment of the shaving apparatus 100 shown in FIGS. 7-8. Upon the establishment of the detachable connection, the first sub-cartridge 103 and the second sub-cartridge 104 collectively form the cartridge 102. In an embodiment, the first sub-cartridge 103 is detachably connected to the second sub-cartridge 104 by fasteners, for example, buttons, buckles, latches, snap fasteners, etc. In another embodiment, the first sub-cartridge 103 is detachably connected to the second sub-cartridge 104, for example, by a bridle joint, a mortise and tenon joint, a finger joint, etc. The first sub-cartridge 103 can be detached from the second sub-cartridge 104 by sliding the tapered sliding dovetail male tongue 901 of the first sub-cartridge 103 out of the sliding dovetail female groove 902 between the set of two groove extensions 902*a* of the second sub-cartridge 104 shown in FIGS. 10A-10B.

Figure 13A:
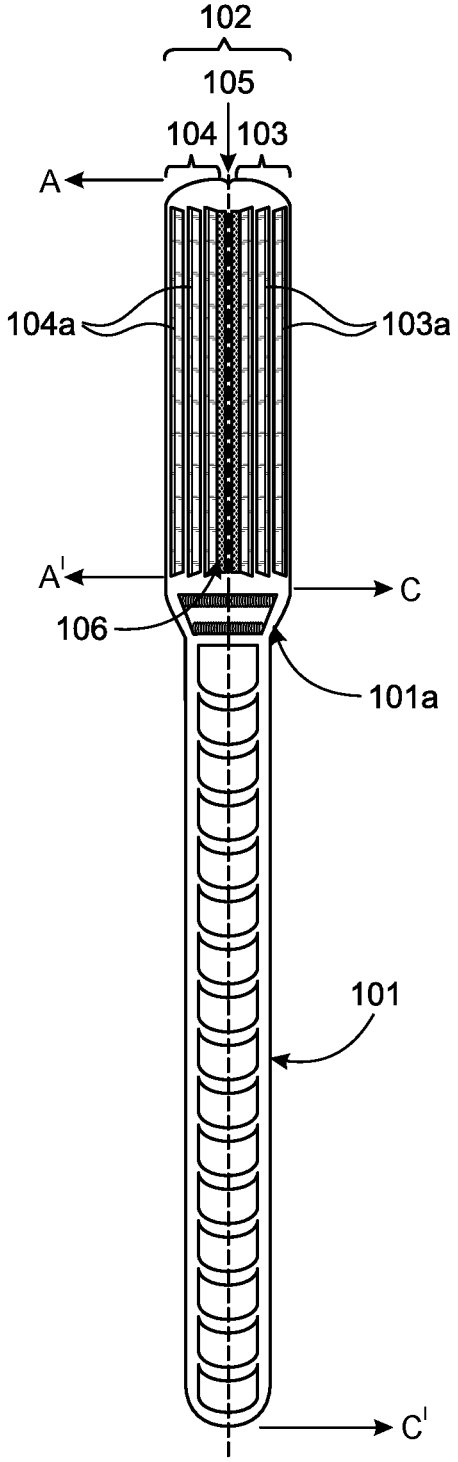
FIG. 13A exemplarily illustrates a front elevation view of an embodiment of the shaving apparatus.
Figure 13B:
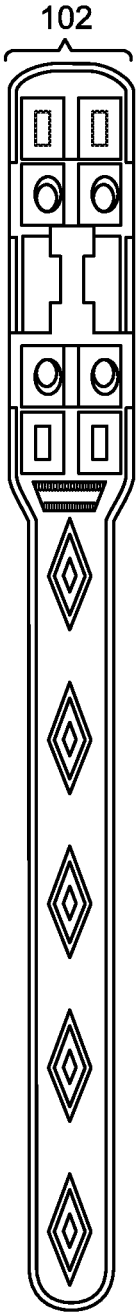
FIG. 13B exemplarily illustrates a rear elevation view of the embodiment of the shaving apparatus shown in FIG. 13A.

FIG. 13A exemplarily illustrates a front elevation view of an embodiment of the shaving apparatus 100. FIG. 13B exemplarily illustrates a rear elevation view of the embodiment of the shaving apparatus 100 shown in FIG. 13A. In this embodiment, the shaving apparatus 100 comprises a handle 101. Furthermore, in this embodiment, the shaving apparatus 100 further comprises a cartridge 102 connected at an upper end 101*a* of the handle 101 such that a longitudinal axis A-A' of the cartridge 102 is oriented substantially collinear to a longitudinal axis C-C' of the handle 101. The cartridge 102 is shaped in a generally elliptical geometric configuration. The cartridge 102 comprises a single sub-cartridge 103 and a lubricating strip 106 positioned at an end portion of the cartridge 102. The sub-cartridge 103 comprises a set of three blades 103*a* oriented outward and in an upward direction and the sub-cartridge 104 includes a set of three blades 104*a* oriented outward and in a downward direction.

Figure 14A:
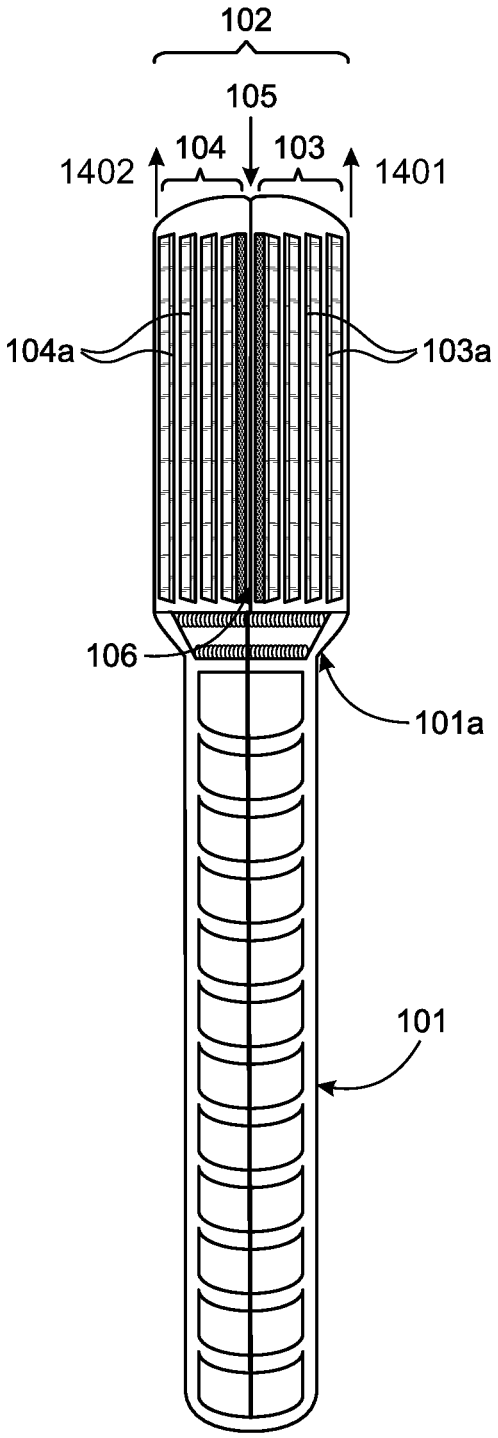
FIG. 14A exemplarily illustrates a front elevation view of an embodiment of the shaving apparatus.
Figure 14B:
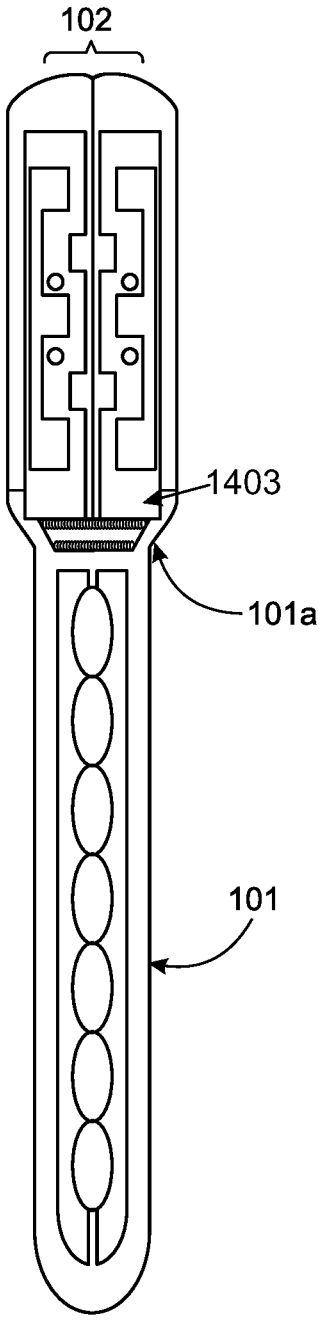
FIG. 14B exemplarily illustrates a rear elevation view of the embodiment of the shaving apparatus shown in FIG. 14A.

FIG. 14A exemplarily illustrates a front elevation view of an embodiment of the shaving apparatus 100. FIG. 14B exemplarily illustrates a rear elevation view of the embodiment of the shaving apparatus 100 shown in FIG. 14A. The cartridge 102 comprises the first sub-cartridge 103, the second sub-cartridge 104, and a lubricating strip 106 positioned on a center portion 105 of the cartridge 102. Furthermore, the cartridge 102 is shaped in a generally cuboidal geometric configuration. The first sub-cartridge 103 and the second sub-cartridge 104 comprise a set of four blades 103*a* and a set of four blades 104*a* respectively, positioned in opposing directions. For example, the blades 103*a* of the first sub-cartridge 103 are oriented outward and in a sideward, for example, left side direction whereas the blades 104*a* of the second sub-cartridge 104 are oriented outward and in a sideward, for example, right side direction. In an embodiment, the first sub-cartridge 103 and the second sub-cartridge 104 are replaceable. The first sub-cartridge 103 and the second sub-cartridge 104 are configured to be individually slid out of a back support 1403 of the handle 101 in a direction of arrows 1401 and 1402 show in FIGS. 14A and 14B. New replacement cartridges, for example, another first sub-cartridge 103 and another second sub-cartridge 104 are slid back into the back support 1403 of the handle 101 in a direction opposite to the direction of arrows 1401 and 1402.

In certain embodiments, the handle 101 is injection molded from semi-rigid polymeric materials that do not wear under normal shaving conditions, such as a blend of PPO and polystyrene, high impact polystyrene, polypropylene, ABS, polytetrafluoroethylene (PTFE), high density polyethylene (HPDE), acetal, nylon, or any combination thereof. The polymeric material is also filled with materials such as silicone, molidium disulfide, or other lubricating agents known to those skilled in the art for reducing friction against the surface of the skin. Those of skill in the art will appreciate that various shaving aids/skin engaging members can be used with embodiments of the present disclosure.

Figure 15A:
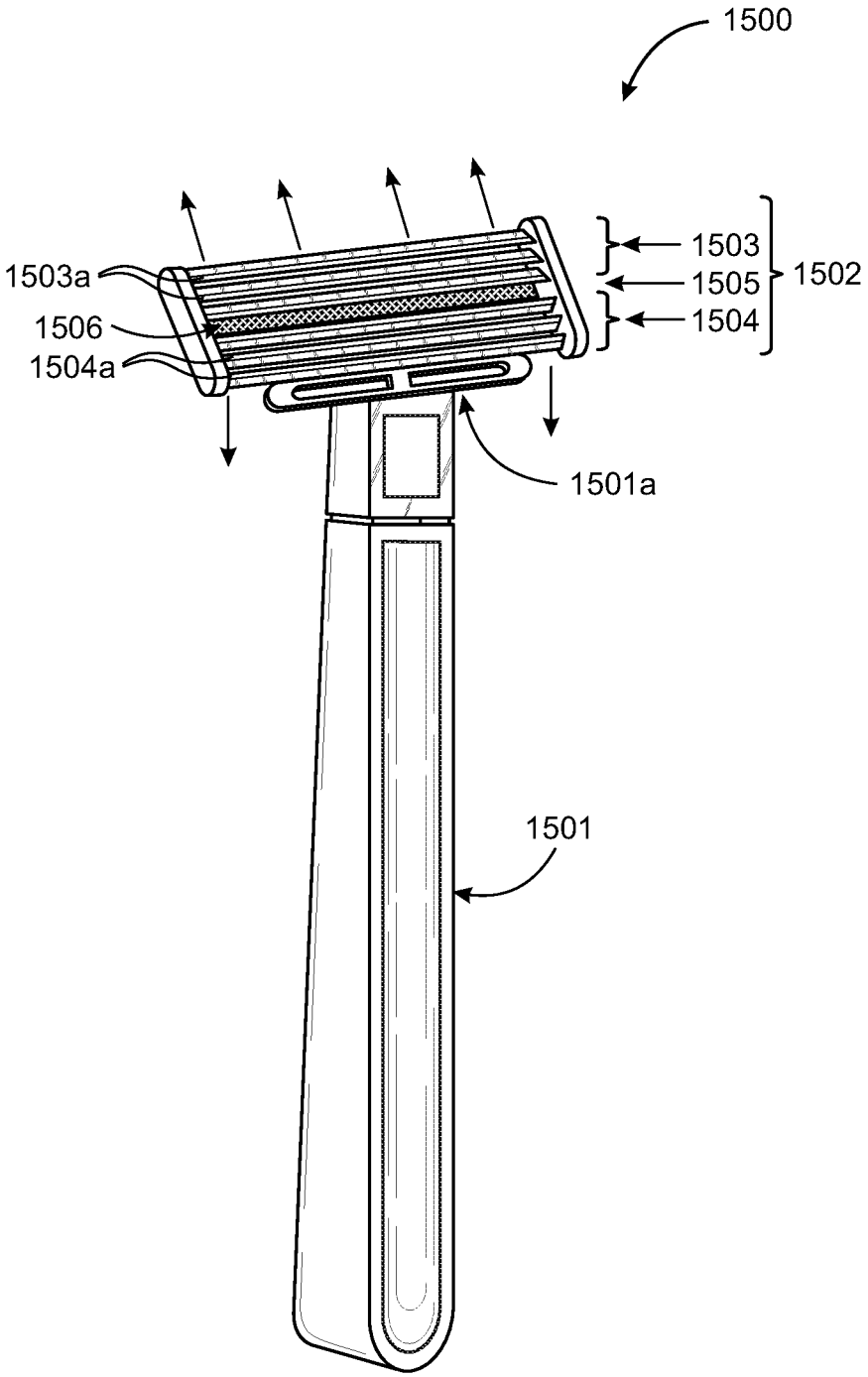
FIG. 15A exemplarily illustrates a front elevation view of an embodiment of the shaving apparatus.
Figure 15B:
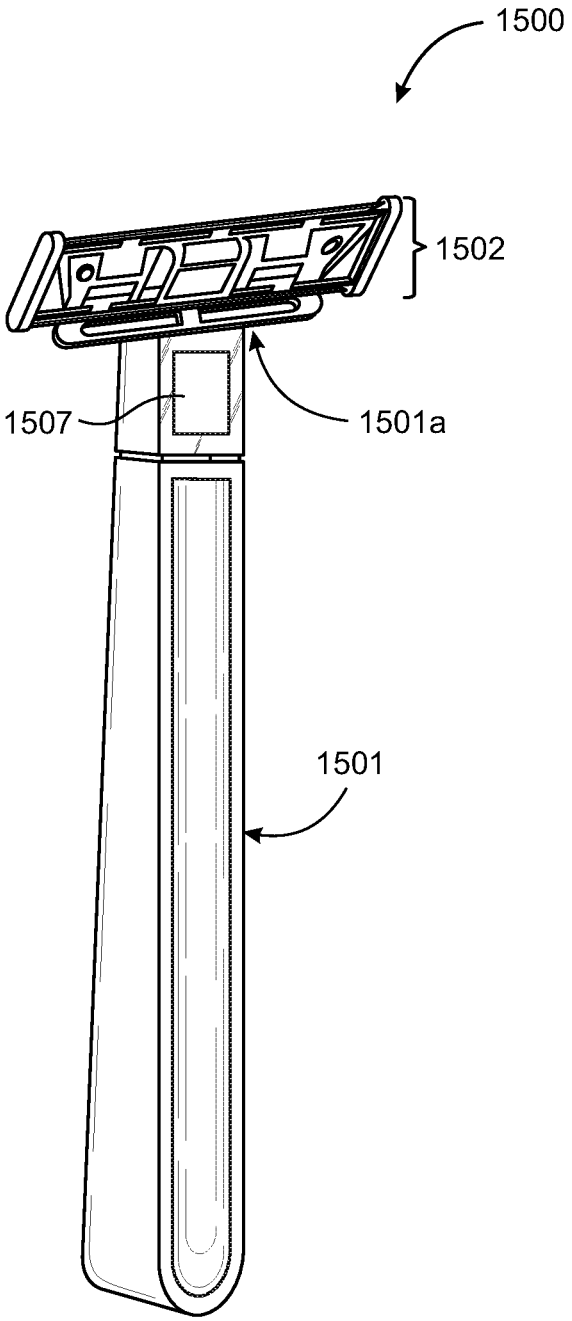
FIG. 15B exemplarily illustrates a rear elevation view of an embodiment of the shaving apparatus shown in FIG. 15A.

FIG. 15A exemplarily illustrates a front elevation view of an embodiment of the shaving apparatus 1500. FIG. 15B exemplarily illustrates a rear elevation view of the embodiment of the shaving apparatus 1500 shown in FIG. 15A. The embodiment is similar to the embodiment of the shaving apparatus 1500, disclosed in FIGS. 2-3, with the only differences being that the cartridge 1502 is inclined at an acute angle relative to the handle 1501, and the blades 1503*a* of the first sub-cartridge 1503 are angled downwards, and the blades 1504*a* of the second sub-cartridge 1504 are angled upwards. In an embodiment, the cartridge 1502 includes the first sub-cartridge 1503 with a set of four blades 1503*a* and the second cartridge 1504 with a set of four blades 1504*a* separated by a lubricating strip 1506 at a center portion 1505 of the cartridge 1502. The cartridge 1502 is inclined at an angle ranging between 0 to 90 degrees relative to the handle 1501 based on design considerations.

In an embodiment, the blades 1503*a* and 1504*a* of the shaving apparatus shown in FIGS. 15A and 15B are about 1.5 inches (3.81 cm) to about 2 inches (5.08 cm) wide and about 1.5 mm to about 3 mm deep. The cutting edge of each of the blades 1503*a* and 1504*a* is about 0.5 mm to about 1 mm deep. In an embodiment, the thickness of each of the blades is about 0.25 mm to about 2.5 mm. In an embodiment, the length of the handle 1501 is about 3 inches (7.62 cm) to about 4.5 inches (11.43 cm).

The foregoing examples have been provided merely for explanation and are in no way to be construed as limiting of the shaving apparatus 100 disclosed herein. While the shaving apparatus 100 has been described with reference to various embodiments, it is understood that the words, which have been used herein, are words of description and illustration, rather than words of limitation. Furthermore, although the shaving apparatus 100 has been described herein with reference to particular means, materials, and embodiments, the shaving apparatus 100 is not intended to be limited to the particulars disclosed herein; rather, the shaving apparatus 100 extends to all functionally equivalent structures, methods and uses, such as are within the scope of the appended claims. While multiple embodiments are disclosed, it will be understood by those skilled in the art, having the benefit of the teachings of this specification, that the shaving apparatus 100 disclosed herein is capable of modifications and other embodiments may be effected and changes may be made thereto, without departing from the scope and spirit of the shaving apparatus 100 disclosed herein.

I claim:

1. A shaving apparatus comprising:

a handle;

a cartridge connected to an upper end of said handle, wherein a central lateral axis of said cartridge is coincident with a central longitudinal axis of said handle, wherein said cartridge comprises:

a pair of sub-cartridges, wherein each of said pair of sub-cartridges comprises one or more blades extending outwardly at an acute angle and projecting generally away from a central longitudinal axis of said cartridge, wherein a first sub-cartridge of said pair of sub-cartridges and a second sub-cartridge of said pair of sub-cartridges are in a detachable engagement with each other, wherein the detachable engagement comprises a sliding dovetail joint having a tapered sliding dovetail male tongue and a tapered sliding dovetail female groove, and wherein one of the tapered sliding dovetail male tongue and the tapered sliding dovetail female groove is located at a lower long side of said first sub-cartridge and facing toward the upper end of said handle, and the other of the tapered sliding dovetail male tongue and the tapered sliding dovetail female groove is located at an upper long side of said second sub-cartridge and facing away from the upper end of said handle.

2. The shaving apparatus of claim 1, wherein said second of said pair of sub-cartridges is a lower sub-cartridge comprising said one or more blades angled substantially downwardly from said central longitudinal axis of said cartridge.

3. The shaving apparatus of claim 1, wherein said first of said pair of sub-cartridges is an upper sub-cartridge comprising said one or more blades angled substantially upwardly from said central longitudinal axis of said cartridge.

4. The shaving apparatus of claim 1, wherein said cartridge further comprises a first guard member positioned adjacent an upper long side of said first sub-cartridge and a second guard member positioned adjacent a lower long side of the second sub-cartridge.

5. The shaving apparatus of claim 1, wherein said cartridge further comprises a first lubricating strip positioned adjacent an upper long side of said first sub-cartridge and a second lubricating strip positioned adjacent a lower long side of the second sub-cartridge.

6. The shaving apparatus of claim 1, wherein said cartridge is connected perpendicular relative to said handle with said central longitudinal axis of said cartridge at a right angle to said central longitudinal axis of said handle.

7. The shaving apparatus of claim 1, wherein a number of blades of said first of said pair of sub-cartridges and a number of blades of said second of said pair of sub-cartridges are equal.

8. The shaving apparatus of claim 1, wherein said first of said pair of sub-cartridges and said second of said pair of sub-cartridges have an unequal number of blades.

9. The shaving apparatus of claim 1, wherein said first of said pair of sub-cartridges is adjacent to and disposed above said second of said pair of sub-cartridges.

* * * * *